US007452498B2

(12) United States Patent
Mizuno et al.

(10) Patent No.: US 7,452,498 B2
(45) Date of Patent: Nov. 18, 2008

(54) PRESSURE-REGULATING DEVICE, TRANSPORTATION VEHICLE, AND PRESSURE DIFFERENCE-CONTROLLING UNIT

(75) Inventors: Hitoshi Mizuno, Toyota (JP); Narumi Ichikawa, Toyota (JP); Kazunori Suzuki, Toyota (JP); Koji Iyoda, Toyota (JP); Kenji Noguchi, Toyota (JP); Tsuyoshi Abe, Toyota (JP)

(73) Assignee: Hoei Shokai Co., Ltd., Aichi (JP)

( * ) Notice: Subject to any disclaimer, the term of this patent is extended or adjusted under 35 U.S.C. 154(b) by 468 days.

(21) Appl. No.: 10/536,867

(22) PCT Filed: Dec. 1, 2003

(86) PCT No.: PCT/JP03/15341

§ 371 (c)(1),
(2), (4) Date: May 27, 2005

(87) PCT Pub. No.: WO2004/050279

PCT Pub. Date: Jun. 17, 2004

(65) Prior Publication Data

US 2006/0108720 A1 May 25, 2006

(30) Foreign Application Priority Data

Nov. 29, 2002 (JP) ..... 2002-349276
Nov. 29, 2002 (JP) ..... 2002-349281

(51) Int. Cl.
*B67D 5/54* (2006.01)
*B67D 5/34* (2006.01)
*C21D 11/00* (2006.01)

(52) U.S. Cl. ..... 266/236; 266/89; 266/143; 266/144; 266/207; 266/208; 266/239; 266/269; 222/591; 222/594; 222/595; 222/603

(58) Field of Classification Search ..... 266/89, 266/143–144, 207–208, 236, 239, 269; 222/591, 222/594–595, 603
See application file for complete search history.

(56) References Cited

FOREIGN PATENT DOCUMENTS

| | | | |
|---|---|---|---|
| JP | 3-31063 | U | 3/1991 |
| JP | 2002-263828 | A | 9/2002 |
| JP | 2002-316255 | A | 10/2002 |
| JP | 2002-316256 | A | 10/2002 |
| JP | 2002-316258 | A | 10/2002 |
| JP | 3492675 | B1 | 2/2004 |

OTHER PUBLICATIONS

Microfilm of the specification and drawings annexed to the request of Japanese Utility Model Application No. 89474/1989 (Laid-open No. 31063/1991) Mar. 26, 1991, Fig.1; pp. 7 to 10 (Family: none).
International Search Report mailed on Mar. 2, 2004.
PRC PO Office Action, App. No. 2066101445332, Nov. 16, 2007 (1 page).

*Primary Examiner*—Roy King
*Assistant Examiner*—Lois L. Zheng
(74) *Attorney, Agent, or Firm*—Rader, Fishman & Grauer, PLLC

(57) ABSTRACT

A pressure controlling apparatus controls a pressure in a container capable of storing a molten metal and supplying the molten metal to an outside using a pressure difference and includes: a supplying portion for supplying a compressed gas to be supplied to the container; a flow passage for supplying the compressed gas from the supplying portion to the container; a first switching valve, being inserted into the passage, capable of manually switching a first mode that enables the passage of the gas between the supplying portion side and the container side and a second mode that enables the passage of the gas between the container side and the outside; an exhausting portion for exhausting a gas from the container; and a second switching valve for switching a pressure applying mode for applying a pressure to the container and an exhausting mode for exhausting the gas from the container.

16 Claims, 12 Drawing Sheets

PRESSURE-REGULATING DEVICE, TRANSPORTATION VEHICLE, AND PRESSURE DIFFERENCE-CONTROLLING UNIT

TECHNICAL FIELD

The present invention relates to a pressure controlling apparatus used for a system for supplying, for example, a molten metal to an outside of a container storing the molten metal such as molten aluminum by applying pressure to an inside thereof, a transporting vehicle and a unit for controlling the pressure difference.

BACKGROUND ART

In a factory where aluminum is molded using many die-casting machines, an aluminum material is often supplied not only from within the factory but also from outside of the factory. In such a case, a container storing aluminum in a melt is carried from a factory on the material supply side to a factory on the molding side to supply to each of a storing furnace of the die-casting machines the material kept in the melt. As an embodiment, a system of applying pressure to an inside of the container and supplying a molten metal from the container to the storing furnace using a pressure difference is recommended (for example, Japanese laid-open utility model application publication H03-31063 (first drawing)).

The technology according to the publication mentioned above is structured such that the supply of molten aluminum from the container to the storing furnace side starts as pressure is being increased and when the supply is stopped later, the supply of the gas from the outside to the inside is switched to exhaust inside of the container, in order to have pressure in the container to become at a state of the atmospheric pressure (page 10 line 7 to line 11 of Japanese laid-open utility model application publication H03-31063).

As the container of this kind stores a molten metal of extremely high temperature, the possibility of having to shutdown the process of applying pressure to the container for some reasons in an emergency is very high. According to the publication, it is possible to cope with such emergency shutdown by switching from supplying gas to exhausting gas.

Nevertheless, in an unexpected event where the switching did not function properly due to electronic trouble and the like caused by noise in the factory, or exhaustion was not performed, there is a very high risk of inducing a serious accident. For this reason, providing, for example, a manually operated valve open to the atmosphere and a valve for blocking the flow passage and manually operate these valves in the event of an emergency may be considered. However, there is a problem that, in such case, switching operation of the two valves is required.

Furthermore, according to the above publication, pressure is applied to inside of the container by a gas supply device mounted on a forklift.

Nevertheless, there is a problem that with such gas supply device, inside of the container cannot be applied with steady pressure.

In such case, for example, compressed gas supplied from pipes running inside the factory may be used. However in that case the container placed on a vehicle such as forklift has to be connected to the factory side through a pipe, which has a negative effect on operability.

DISCLOSURE OF THE INVENTION

An object of the present invention is to provide a pressure controlling apparatus that is capable of shutting down application of pressure to the container and supply of the molten metal from the container to the outside in an emergency with a very simple operation and, in the same time, without fail.

In addition, an object of the present invention is to provide a unit for controlling pressure difference capable of steadily applying pressure to the inside of the container without negatively affecting operability and a transporting vehicle.

Furthermore, an object of the present invention is to provide a transporting vehicle and a unit for controlling pressure difference that is efficient and small in size. Especially, an object of the present invention is to provide a technology that uses a little amount of compressed gas and consumes little energy. Additionally, an object of the present invention is to provide a technology with a small number of replenishment of the compressed gas and with an excellent operability.

To solve the problem, the main object of the present invention is to provide a pressure controlling apparatus for controlling a pressure in a container capable of storing a molten metal and supplying the molten metal to an outside using a pressure difference comprises, a supplying portion for supplying a compressed gas to be supplied to the container, a flow passage for supplying the compressed gas from the supplying portion to the container and a first switching valve, being inserted into the passage, capable of manually switching a first mode that enables the passage of the gas between the supplying portion side and the container side and a second mode that enables the passage of the gas between the container side and the outside.

In the present invention, in a case where applying pressure to the inside of the container is to be shutdown in an emergency, the first valve is manually switched from the first mode to the second mode. With such configuration, inside of the container can be released to the atmosphere, in the same time as the application of pressure to the inside of the container is stopped. This makes it possible to stop the application of pressure to the container 100 with more reliability in an emergency, and with a very simple operation. In other words, according to the pressure controlling apparatus of the present invention, the first mode and the second mode can be switched from one mode to the other exclusively with one same operation, which is very effective when the supply of the molten metal is to be stopped in an emergency. For this reason, due to the present invention safety, stability and reliability of the system can be improved. Of course, the supply of the molten metal may be stopped any time other than in emergency using the structure of the present invention. In addition, since the first switching valve of the present invention can be structured, for example, with a three-way valve, the number of parts can be reduced.

The above-described supplying portion is, for example, a tank for storing the compressed gas mounted on a transporting vehicle equipped with a pressure controlling apparatus, and a flow passage and the like connected to a tank for supplying compressed gas on the factory side. Further, a compressor may be connected to the above-described tank. Of course the compressor may be mounted on the transporting vehicle mentioned above. In such case, the compressor may be supplied with electricity from a dynamo of the transporting vehicle. Additionally, when the transporting vehicle is driven with the battery as well, the compressor may be supplied with electricity from the battery.

The flow passage of the present invention can be, for example, an air tube, air hose and the like.

According to the pressure controlling apparatus of the present invention, a valve open to the atmosphere connected to the flow passage (i.e. inserted between the flow passage and the valve open to the atmosphere) and a controlling means for controlling the opening and closing of the valve may be provided. The valve open to the atmosphere and the controlling means are structured differently from the emergency shutdown means for shutting down the application of pressure to the inside of the container.

A transporting vehicle for mounting a pressure controlling apparatus of the present invention as described above comprises a part of flow passage being a flexible air tube having a connecting portion for connecting with the container. At the end of the air tube, a second joint portion that is detachably connected with the first joint portion provided to the container is provided. The vehicle preferably be comprised further of a fork portion capable of inserting into and pulling out from a pair of channel member provided on a back side of the bottom of the container.

Therefore, one transporting vehicle mounted with the pressure controlling apparatus of the present invention can transfer a plurality of containers and can supply molten metal to a plurality of use points. The present invention differs from the system of the above referenced publication in which the container and the vehicle are integrated from that point of view.

A pressure controlling apparatus of the present invention comprises, an exhausting portion for exhausting a gas from the container, a second switching valve for switching pressure applying mode for applying a pressure to the container and an exhausting mode for exhausting the gas from the container. The flow passage includes a first path for connecting the supplying portion and the second switching valve, a second path for connecting the exhausting portion and the second switching valve, a third path connecting the second switching valve through to the container side. The first switching valve may be inserted into the third path.

Here, the exhausting portion may be, for example, a vacuum pump mounted on the transporting vehicle, also may be an interface portion provided for being connected with the exhaustion facility in the factory.

The body of the switching valve is generally made of resins, however, there occurs a problem when being used in a system such as treating molten metals in which the valve is exposed to an environment of temperature being as high as 700 degrees Celsius. In other words, temperature of the compressed gas in the container is very high due to the heat from the molten metal, and when the compressed gas is to be released, the valve is likely to be thermally damaged thus the reliability may be questioned. Especially, the reliability is a serious problem for valves relating to safety, such as the leak valve and the relief valve. Therefore, from the point of view of reliability and the cost, it is desirable not to have valves open to the atmosphere in the container, however, a container without a safety valve can be dangerous. Such kind of danger can be avoided at an utmost by adopting the switching valve of the present invention. In addition, the safety can even be improved in a new system of providing a valve open to the atmosphere to a pressure controlling apparatus side not on the container side.

Another aspect of the present invention is a transporting vehicle for transporting a container capable of storing a molten metal and supplying the molten metal to an outside using a pressure difference comprises an engine for driving the vehicle, a generator driven by the engine, a compressor driven by an electricity generated by the generator, a tank for storing a compressed gas compressed by the compressor and a pressure controlling portion, having an interface portion detachably disposed against the container, for applying a pressure in the container via the interface portion.

Yet another aspect of the present invention is a transporting vehicle for transporting a container capable of storing a molten metal and supplying the molten metal to an outside using a pressure difference comprises a motor for driving the vehicle, a battery for supplying an electricity to the motor, a compressor driven by the electricity in the battery, a tank for storing a compressed gas compressed by the compressor and a pressure controlling portion, having an interface portion detachably disposed against the container, for applying a pressure in the container via the interface portion. According to the present invention, for example, a generator is driven by an engine mounted on the transporting vehicle while being run and/or idled and the generated electricity is used to drive the compressor and the compressed gas is stored in a tank. Alternatively, the gas compressed by the compressor driven by the battery for supplying electricity to a motor for running the vehicle is stored in the tank. Then, an interface portion provided at a tip of the air tube leading to the tank is connected to the container, and inside the container is applied with pressure from the tank through the air tube, having the molten metal stored in the container flow to an outside.

According to the present invention, since the gas is compressed by the compressor and temporarily stored in the tank, the tank plays a role of, so-called a "buffer" between the compressor and the container. For this reason, the pressure can be applied to inside of the container steadily. In addition, since all the means for applying pressure is designed so that it is being on the transporting vehicle, the vehicle independently functions as an apparatus for applying pressure. With this configuration, it becomes not necessary, for example, to be connected with pipes flowing the compressed gas therein in the factory, and the operability improves.

In addition, the present invention can be applied not only to a vehicle driven by gasoline but also to a vehicle driven by an electricity driven, so-called, a "hybrid".

A transporting vehicle of the present invention may be disposed with a filter on a line connecting between the compressor and the tank. The filter preferably catches a fragment of aluminum or moisture in the fluid. The filter is usually provided to prevent particles and the like from flowing to the container side. Especially, as the filter catches the moisture, the dried gas can be supplied to the container side, and the safety can be improved.

A transporting vehicle according to the present invention may be disposed with a first check valve that regulates the flow of gas from the tank to the compressor. By regulating the flow of gas from the tank to the compressor using the first check valve, pressure is not applied to the compressor from the tank side, decreasing the load of the compressor. With this configuration, the compressor can be made smaller. In addition, due to the first check valve, the particles do not flow to the opposite direction, i.e. to the compressor side. The first check valve is preferably provided between the filter and the compressor. With this configuration, the particles and the like do not flow to the tank side or to the compressor side.

An transporting vehicle according to the present invention, may be comprised of means for measuring pressure in the tank and means for controlling start and stop of the compressor according to the measured pressure as well as releasing the pressure between the compressor and the first check valve to the atmospheric pressure before starting up the compressor.

For example, the pressure release controlling device has a function of the measuring means and the controlling means described as above.

As controlling the start and the stop of the compressor according to the pressure in the tank, the pressure in the tank can be kept constant. With this configuration, the pressure can be applied to inside of the container steadily. In addition, since the pressure between the compressor and the first check valve is released to atmospheric pressure before activating the compressor, i.e. upon activating the compressor, the compressor can be started with less power. When one tries to start the compressor from the state of it being applied with pressure, the compressor initially needs extra power to resist to the applied pressure that causes the compressor to become larger in size. In contrast, in the present invention, because the power necessary to start the compressor can be made small, the compressor can also be made small. For example, a function of releasing pressure to atmospheric pressure as described above can be realized as the controlling means has at least one valve and one end of which is connected to the atmospheric pressure and the other end is connected to the line between the first check valve and the compressor.

According to the transporting vehicle of the present invention, it is preferable that the container has a hatch capable of being opened and closed on a top surface of the container and the interface portion is detachably provided against the hatch.

In the present invention, because the interface portion is detachably provided against the hatch, the adhesion of the molten metal at a mounting position of the interface portion in the backside of the hatch can be checked every time the molten metal is being supplied in the container. This makes it possible to prevent clogging of the portion beforehand.

Yet another aspect of the present invention is a transporting vehicle for transporting a container capable of storing a molten metal and supplying the molten metal to an outside using a pressure difference comprises a compressor, a tank for storing a compressed gas compressed by the compressor, an air tube, having an interface portion detachably disposed against the container on one end and a first leak valve disposed between the tank and the interface portion and on one of the first line and the third line, and a filter disposed between the first leak valve and the interface portion.

Here, it is preferable to provide a second leak valve between the first leak valve and the interface portion and the filter is preferably provided between the second leak valve and the air tube.

In the present invention, as valves of this kind is being fixed between the tank and the interface portion, the damage of the valves caused by the heat and the like and deterioration of the valve can be prevented, so that the molten metal can be treated more safely. Additionally, the valve and the like do not have to be provided by each container, therefore the number of parts for the container can be reduced. Moreover, in the present invention, since the filter is provided between the first leak valve and the interface portion, the first leak valve being stuck caused by particles and the like from the container side does not occur any more. Therefore the leakage of pressure can be prevented. In addition, the leakage of pressure can be prevented more effectively by providing a filter, for example, a strainer right in front of the first leak valve.

Another aspect of the present invention is a transporting vehicle for transporting a container capable of storing a molten metal and supplying the molten metal to an outside using a pressure difference, comprises a compressor, a tank for storing a compressed gas compressed by the compressor, a vacuum pump, an air tube, having an interface portion detachably disposed against the container on one end, a switching portion switching a flow passage leading to the tank and a flow passage leading to the vacuum pump and a pipe disposed between the switching portion and the other end of the air tube.

In the present invention, the vacuum pump as means for decreasing pressure is designed to be mounted on the vehicle, the vehicle independently functions as an apparatus for increasing and decreasing pressure. Therefore, for example, not only connection with pipes for the compressed gas becomes unnecessary in the factory, but also connection with pipes provided for vacuuming also becomes unnecessary. In summary, the vehicle and the container enable independent supply of the molten metal from outside and also supply of the molten metal from the container to the outside. In addition, according to the present invention, since a common air tube is used in both application and reduction of pressure, the number of parts can be decreased as well.

The transporting vehicle according to the present invention is preferably further comprised of a first leak valve disposed between the tank and the interface portion and a filter disposed between the first leak valve and the interface portion. Moreover, the transporting vehicle according to the present invention is preferably further comprised of a second leak valve disposed between the switching portion and one end of the air tube and a filter disposed between the second leak valve and the air tube.

Yet another aspect of the present invention is a pressure difference controlling unit being mounted on a transporting vehicle holding a container capable of storing a molten metal and supplying the molten metal to an outside using a pressure difference, comprises a compressor, a tank for storing a compressed gas compressed by the compressor and a pressure controlling portion, having an interface portion detachably disposed against the container, for applying a pressure in the container via the interface portion with the compressed gas.

A constant pressure can be applied to the inside of the container without negatively affecting the operability by disposing the pressure difference controlling unit according to the present invention on a transporting vehicle such as a forklift and the like and by using the above-described container.

The pressure difference controlling unit of the present invention is able to adopt the same structure as described above.

In other words, being provided with a filter disposed on a line between the compressor and the tank and further being provided with a first check valve disposed on the line between the tank and the interface portion regulating the gas flow from the tank to the compressor, the first check valve is being provided between the first check valve and the compressor, further being provided with a second check valve disposed on the line so that the filter is placed between the first check valve and the second check valve, and also further comprised with means for measuring pressure in the tank and controlling means for controlling start and stop of the compressor and for releasing pressure between the compressor and the first check valve to an atmospheric pressure before start-up of the compressor, and said controlling means has at least one valve one end of which is connected to the atmospheric pressure and the other end is connected to the line between the first check valve and the compressor etc.

The pressure difference controlling unit of the present invention is preferably driven by a mono-layer electricity. With this configuration, the electricity supply system can be made smaller compared with that of "three phase types".

The present invention described above is the one with a tank, however, a blower may be used as a source of applying pressure to the container instead of a tank. When smaller sized transporting vehicle is required considering the size and running space of the transporting vehicle, a blower may be used instead of a tank. Both the blower and the tank may surely be used.

BEST MODE FOR CARRYING OUT THE INVENTION

Hereinafter, embodiments of the present invention will be described with reference to the drawings.

Figure 1:
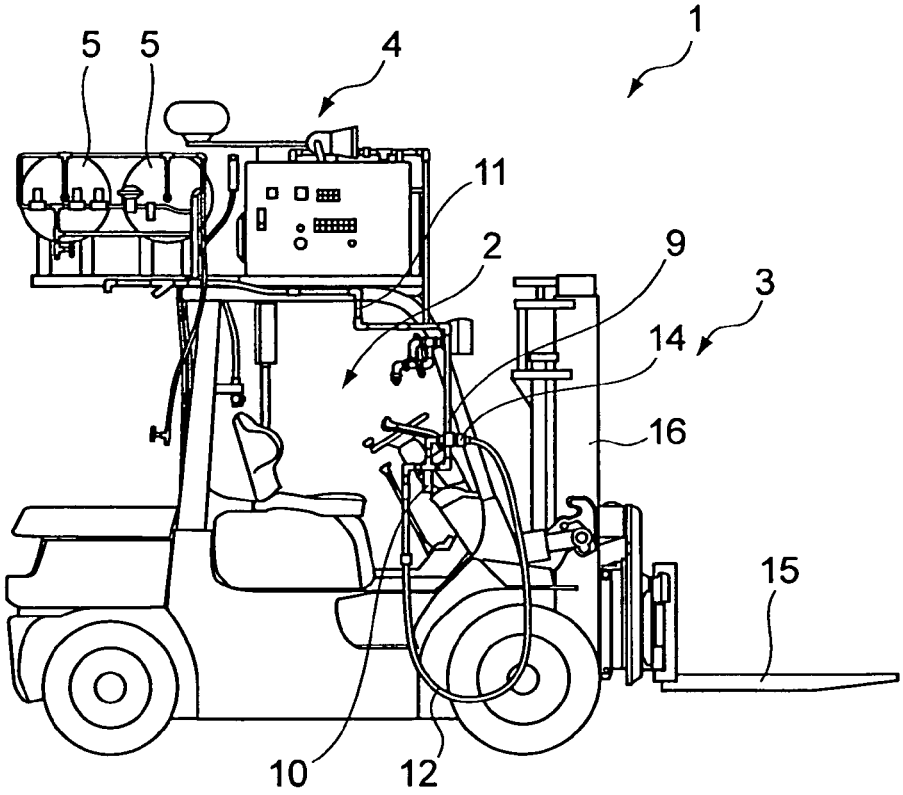
FIG. 1 is a front view showing the structure of a transporting vehicle according to one embodiment of the present invention.
Figure 2:
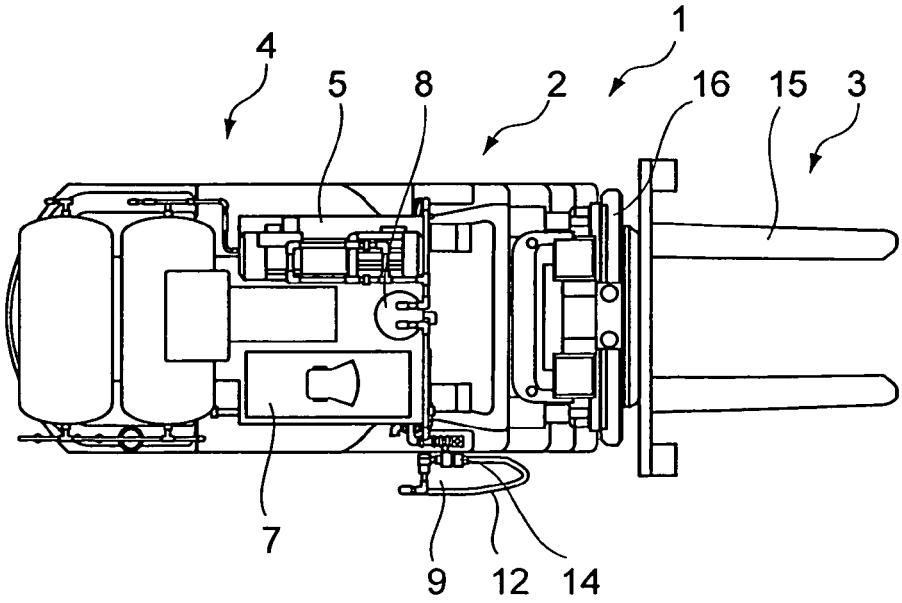
FIG. 2 is a plane view of the transporting vehicle shown in FIG. 1.

FIG. 1 is a side view showing the structure of a transporting vehicle according to one embodiment of the present invention. FIG. 2 is a plane view thereof.

The transporting vehicle 1 is basically a forklift. The transporting vehicle 1 has a driving seat 2 provided almost center of the vehicle, a fork portion 3 provided at the front of the vehicle and a pressure controlling apparatus 4 provided on the top of the vehicle 1.

The pressure controlling apparatus 4 has two receiver tanks 5 for storing gas to be supplied for applying pressure to the inside of the container 100, an a compressor 6 for supplying the gas to be compressed to the receiver tank, a vacuum pump 7 for reducing the pressure in the container 100, a filter 8 and an emergency shutdown portion 9.

The emergency shutdown portion 9 is disposed at a front and one side of the driving seat 2. With this configuration, a driver seated at the driving seat can access to a lever 10 for shutting down the operation in an emergency provided at the emergency shutdown portion 9.

The emergency shutdown portion 9 is inserted between a pipe 11 inside the pressure controlling apparatus 4 and an air tube 12. The gas used for applying pressure to inside of the container is discharged from a tip of the air tube 12 through the pipe 11, emergency shutdown portion 9 and the air tube 12.

At the tip of the air tube 12, a joint portion 14 is detachably disposed against a joint portion 13 provided in the container 100. Then the joint portion 14 of the tip of the air tube 12 is connected to the joint portion 13 in the container 100 and inside of the container 100 can be applied with pressure by supplying the gas to the inside of the container 100 from the receiver tank 5 through the air tube 12. Similarly, the joint portion 14 of the tip of the air tube 12 is connected to the joint portion 13 in the container 100 and the pressure in the container 100 can be decreased using a vacuum pump 7 of the pressure controlling apparatus 4 through the air tube 12. As a material for the air tube 12, for example, a synthetic resin such as rubber or a metal can be used. The material is preferably heat resistant since the air tube is positioned close to the container 100 bearing high temperature.

A fork portion 3 has a fork 15 detachably disposed against a pair of a channel member 171 which is provided at the back of the bottom portion of the container 100 and an ascending and descending mechanism 16 for ascending and descending the fork 15.

Figure 3:
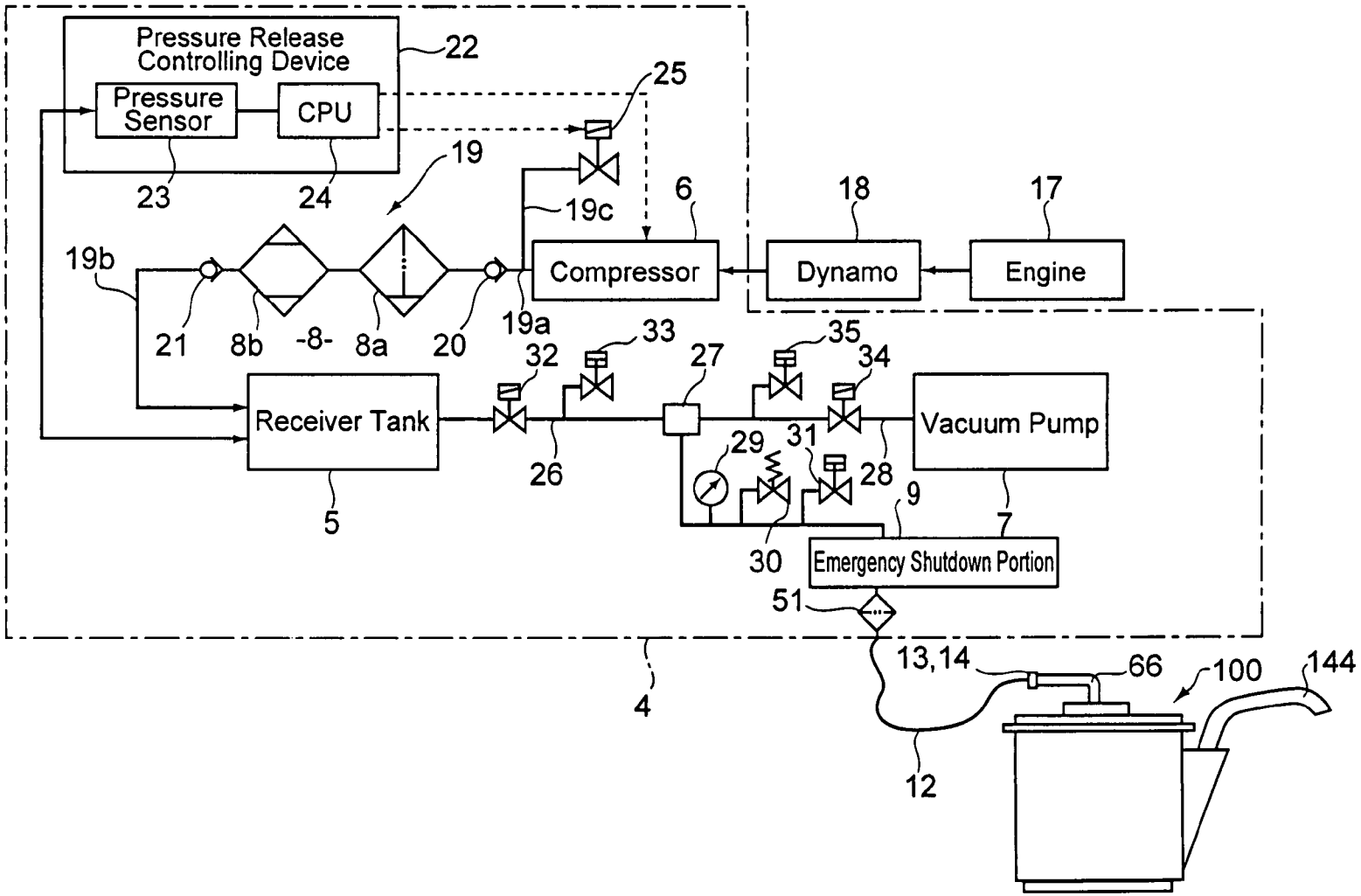
FIG. 3 is a diagram showing a structure of the pressure difference controlling apparatus according to one embodiment of the present invention.

FIG. 3 is a diagram showing a structure of a pressure controlling apparatus.

As shown in FIG. 3, the pressure controlling apparatus 4 has at least an electric generator 18 driven by an engine 17 for driving the transporting vehicle 1 which causes the vehicle to run or idle and a compressor 6 driven by the generated electricity. When the transporting vehicle 1 is driven using a battery and a motor, the compressor 6 is driven using the battery, in which case, the compressor can be operated independently from running or idling of the vehicle.

Then, the gas used for applying pressure to the inside of the container compressed by the compressor 6 is stored in the receiver tank 5. In other words, the compressed gas is stored in the receiver tank 5 from the compressor 6 while the transporting vehicle 1 is running or idling. Therefore, the receiver tank 5 is configured as, so called "a buffer", between the compressor 6 and the container 100. With this structure, when the molten metal is supplied from the container 100 to an outside, an inside of the container 100 can be applied with a constant pressure. In addition, the gas can constantly be charged to the receiver tank 5 enabling the supply of the molten metal to the outside to be performed flexibly, anytime, anywhere.

Applying constant pressure to the inside of the container is extremely important according to the understanding of the inventors and the like of the present invention. When the pressure applied to the inside of the container 100 is unstable, often there occurs the case where the molten metal containing gas suddenly gushes out from the tip of the pipe 144 of the container 100, spattering the molten metal to its surroundings. In addition, by providing the receiver 5, the capacity of the compressor 6 may be small. Therefore the compressor 6 with a small amount of electricity consumption and small in its size can be used.

A first check valve 20, a line filter 8*a*, an gas drier 8*b* and a second check valve 21 are provided on the pipe 19 between the compressor 6 and the receiver tank 5 disposed in consecutive order from the compressor 6 side. Both of the first check valve 20 and the second check valve 21 are provided to prevent reversal flow of the gas from the receiver tank 5 side to the compressor 6 side. The first check valve 20, for example, prevents the reverse flow of the gas from the line filter 8*a* and the gas drier 8*b* side to the compressor 6, and especially preferable to be provided close to the line filter 8*a*.

With such configuration, the pipe 19*a* between the compressor 6 and the line filter 8*a* can be prevented effectively from becoming dirty and/or being stuck.

The line filter 8*a* is a filter for removing moisture and grease from the gas supplied from the compressor 6 to the receiver tank 5. The gas drier 8*b* is a filter for drying the gas supplied from the compressor 6 to the receiver tank 5.

The second check valve 21 is provided to prevent the reverse flow of the gas from the receiver tank 5 side to the compressor 6. A pressure release controlling device 22 is connected to the pipe 19*b* disposed between the receiver tank 5 and the second check valve 21.

The pressure release controlling device 22 has a pressure sensor 23 and a CPU 24. The pressure sensor 23 detects pressure in the receiver tank 5 and controls "ON" and "OFF" of the compressor 6 based on the detected result. For example, the compressor 6 is turned ON when the pressure in the receiver tank 5 is lower than a predetermined value. On the other hand, the compressor 6 is turned OFF when the pressure in the receiver tank 5 is higher than the predetermined value.

A pipe 19*c* is connected to the pipe 19*a* disposed between the compressor 6 and the first check valve 20. One end of the pipe 19*c* is released to an atmosphere through a leak valve 25. Opening and closing of the leak valve 25 is controlled by the CPU 24 of the pressure release controlling device 22.

The CPU 24 opens the leak valve 25 from its closed state before turning on the compressor 6 when the pressure in the receiver tank 5 is lower than the predetermined value. This causes the pressure in the pipe 19*a* disposed between the compressor 6 and the first contact valve 20 to return to an atmospheric pressure. Then the CPU 24 turns on the compressor 6 and closes the leak valve 25 after a predetermined time. Having pressure in the pipe 19*a* to return temporarily to the atmospheric pressure, the compressor 6 can be started-up with less energy, enabling reduction in size of the compressor 6.

In the present invention, the pipe on the upstream side of the receiver tank 5 is narrower compared to the downstream side (i.e. the side closer to the container 100), for example, the diameter of the pipe at upstream side is narrower by two-third. This is because while large amount of the compressed gas is released at once from the receiver tank 5 to the container 100, the gas is released gradually from the compressor 6 to the receiver tank 5. In other words, the flow rate of the gas between the receiver tank 5 and the container 100 differs greatly from the flow rate of the gas between the compressor 6 and the receiver tank 5.

Then, in the present invention, the line filter 8*a* and the gas drier 8*b* can be reduced in size as being provided to the upstream side of the receiver tank 5, not the downstream side thereof, namely, in the pipe 19 disposed between the receiver tank 5 and the compressor 6, where the pipe being narrower and has smaller flow rate.

The receiver tank 5 is connected to a pipe 26 for compressed gas and the pipe 26 is connected to a switching valve 27 comprised of, for example, a three-way valve. In addition, the vacuum pump 7 is connected to a pipe 28 for vacuum pumping and the pipe 28 is connected to the switching valve 27. The switching valve 27 switches the connection between the pipe 26 for the compressed gas and the air tube 12 side, and the connection between the air tube 12 side and the pipe 28 for vacuum pumping. The switching valve 27 is connected to the tip of the air tube 12 through a pressure gauge 29, a relief valve 30, a leak valve 31 and the emergency shutdown portion 9.

An electronic pressure control valve 32 and the leak valve 33 are connected to the pipe 26 for compressed gas on the pressure receiver tank 5 side (upstream side). An electronic pressure control valve 34 and the leak valve 35 are connected to the pipe 28 for vacuum pumping on the vacuum pump 7 side (downstream side).

Each of the electronic pressure control valve 32 and the electronic pressure control valve 34 is designed to control pressure in the pipe 26 for compressed gas and the pipe 28 for vacuum pumping.

The filter 51 prevents dust and the like to enter into (the filter) the emergency shutdown portion 9 from the container 100 side. The problem of this kind occurs especially often when supply of the molten metal is stopped, namely when the pressure returns from an increased pressure state to the atmospheric pressure. The filter 51 may be provided on the container 100, however, in that case, the filter needs to be provided to every container 100. In the present invention, the number of filters to be used and time consuming maintenance operation can be reduced, as the filter 51 is provided on the transporting vehicle 1 side.

According to the knowledge of the inventors of the present invention, amount of dust and dirt transmitted from the container side to the receiver tank 5 side is much larger compared to the amount of dust and dirt from the receiver tank 5 side to the container side. In the present invention, providing the filter 51 on the downstream side of the valves and the emergency shutdown portion 9 enables to prevent the relief valve 30 and other valves from being stuck caused by dirt and dust transmitted from the container 100 side. However, the filter 51 may be disposed on the upstream side, or alternatively a plurality of filters may also be disposed in a plurality of places. For example, the filter 51 may be provided between the switching valve 27 and the relief valve 30 and the filter 31 may be provided between the switching valve 27 and the leak valve 33.

An electric control board electronically controls these electronic pressure control valve and the valve system (not shown). The pressure difference between inside of the container 100 and outside can be adjusted by manipulating a controlling panel (not shown) provided close to the driver.

Figure 4:
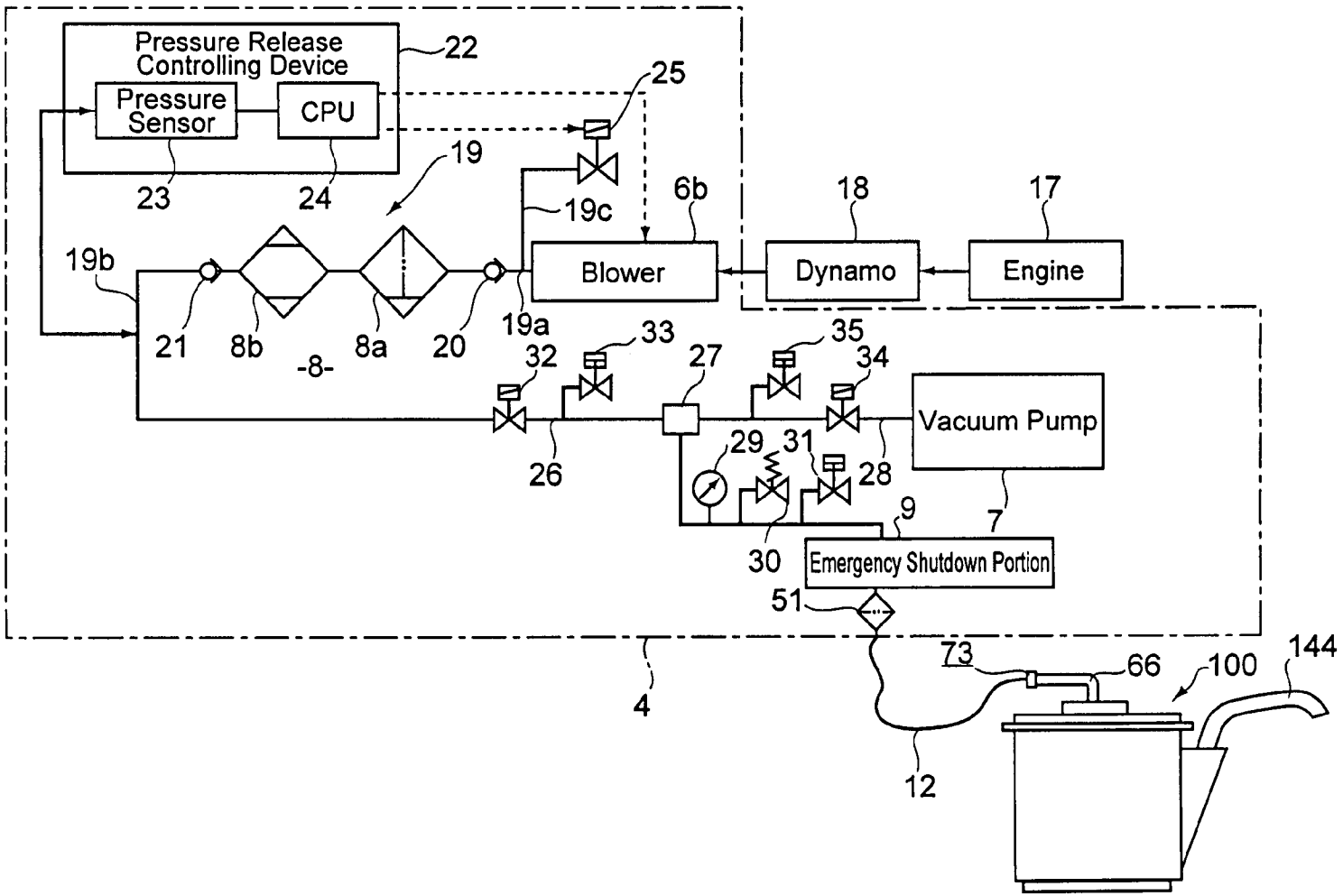
FIG. 4 is a diagram showing the structure of the pressure difference controlling apparatus in relation to a forklift and a container according to one embodiment of the present invention.

FIG. 4 is a diagram explaining another embodiment of the present invention. In this example, a blower 6*b* is used as a pressure source instead of the compressor 6 and the system is structured as such that the compressed gas is provided to the container 100 side without using the receiver tank 5. With this configuration, the pressure controlling apparatus 4 can be reduced in size. When the transporting vehicle 1 is a battery car, the electricity of the blower 6*b* may be obtained from the battery.

Figure 5:
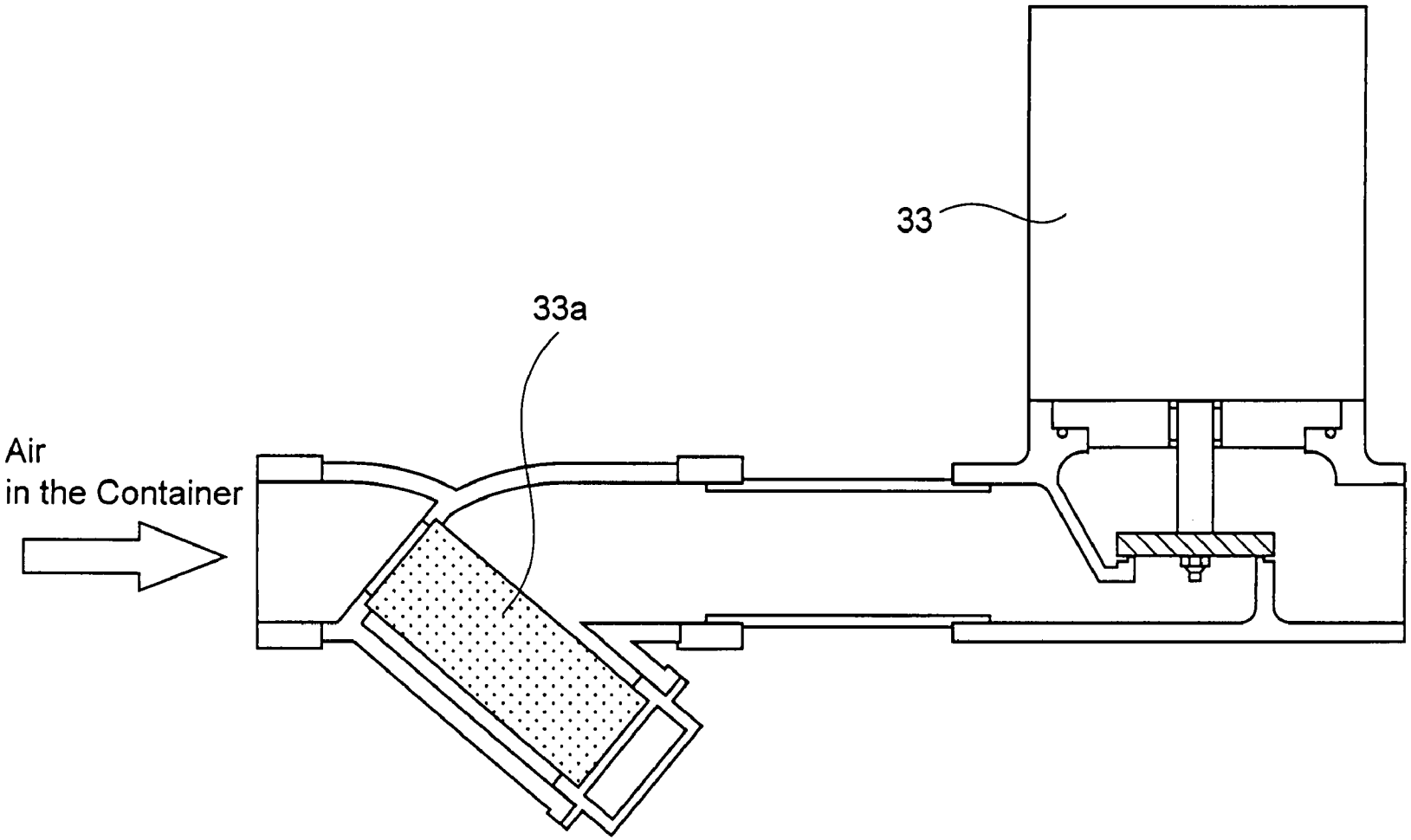
FIG. 5 is a diagram showing a structure of a leak valve according to an embodiment of the present invention.
Figure 6:
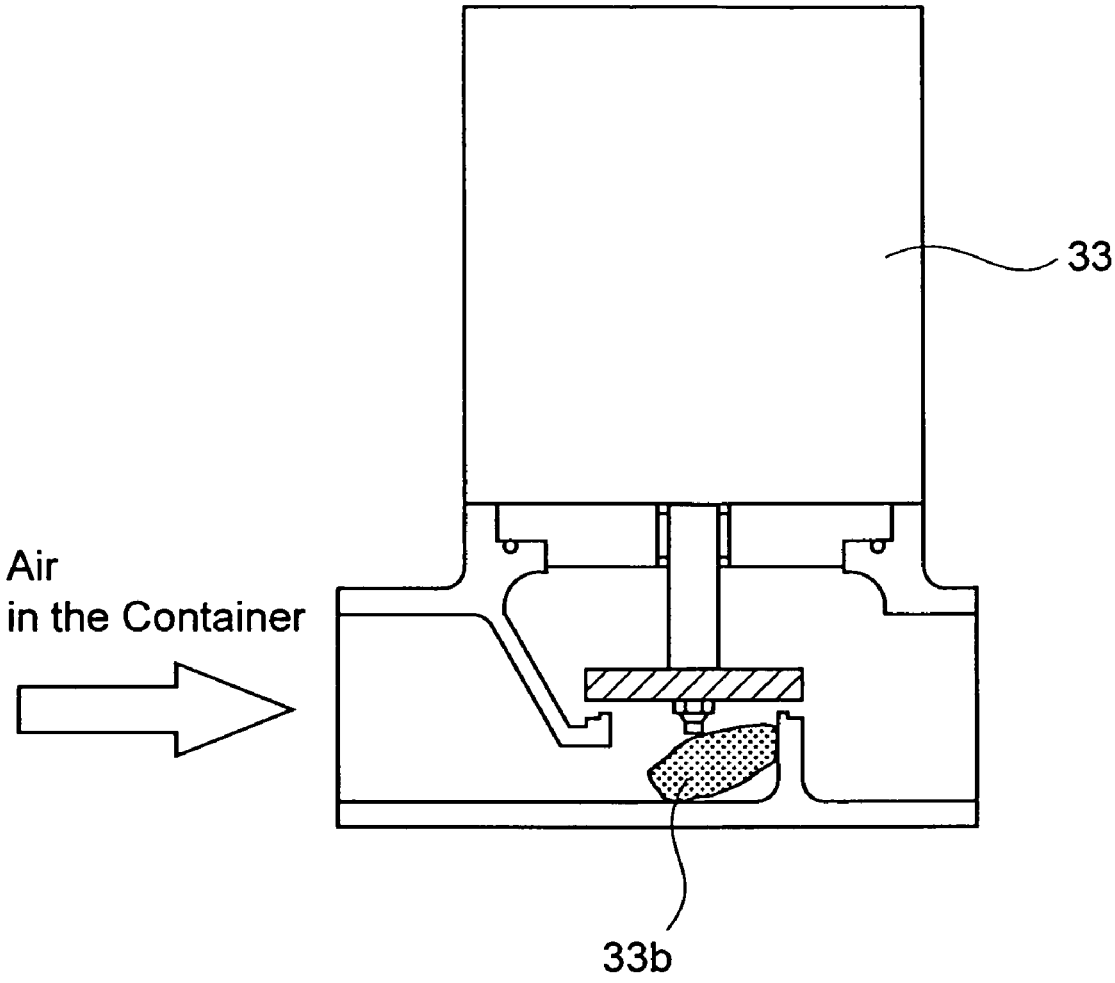
FIG. 6 is a diagram showing a structure of a typical leak valve of the prior art.

FIG. 5 is a diagram showing a preferable embodiment of the leak valve 33. As shown in FIG. 5, in this embodiment, a strainer 33*a* is inserted in the position immediately before the leak valve 33. As shown in FIG. 6, when a strainer such as the strainer 33 is not inserted, the leak valve 33 is clogged with an object 33*b*, such as pieces of aluminum or fire refractory materials and the like transmitted from the container 100 side. As a result, the valve does not close, which may cause pressure leakage and may affect stopping operation of the supply of the molten metal. In contrast, according to the present invention, because of the inserted strainer 33*a*, the pressure leakage can be prevented and safe stopping operation can be realized.

Next, the emergency shutdown portion 9 will be described.

Figure 7:
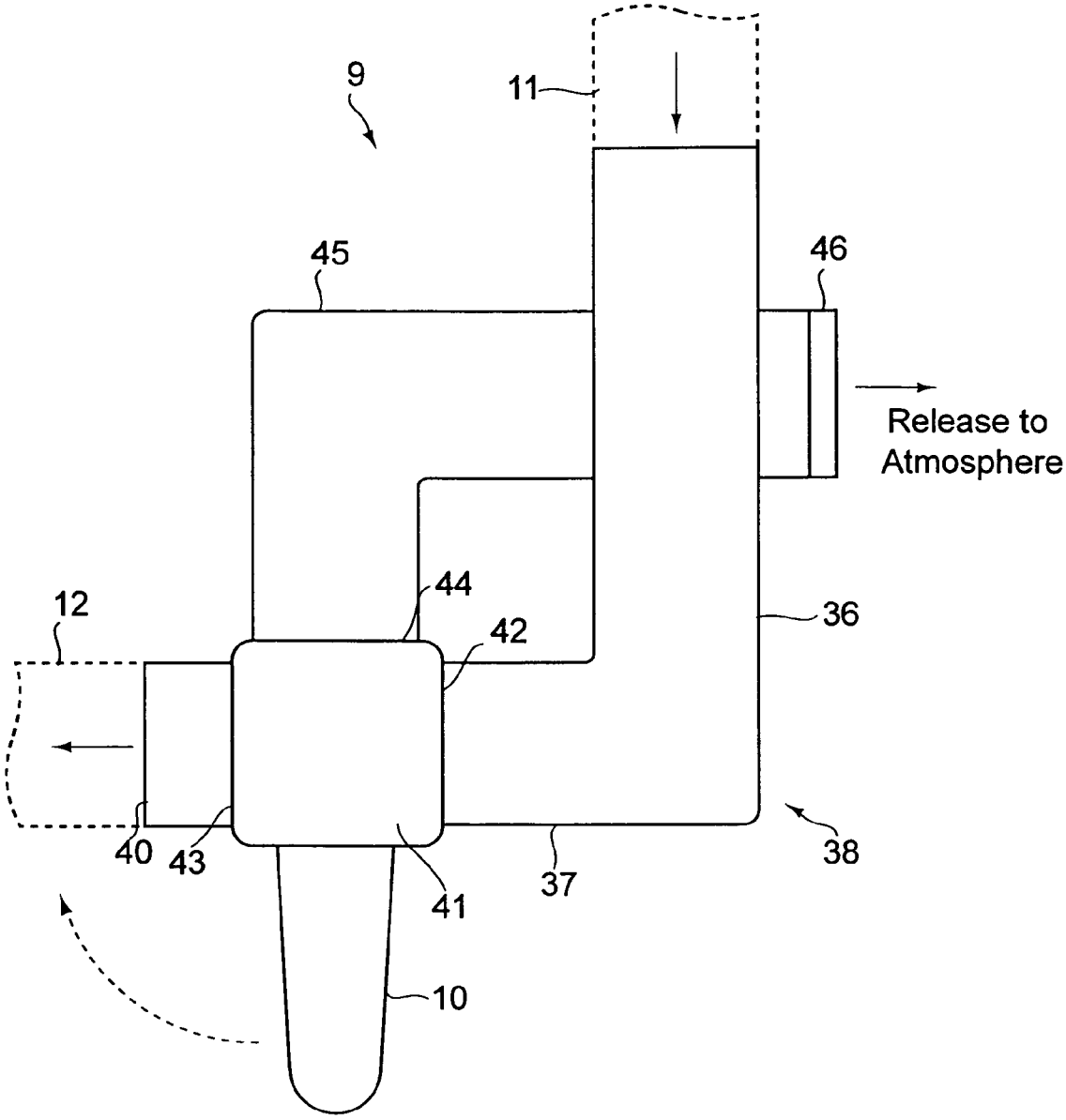
FIG. 7 is a diagram showing a structure of an emergency shutdown portion according to an embodiment of the present invention.
Figure 8:
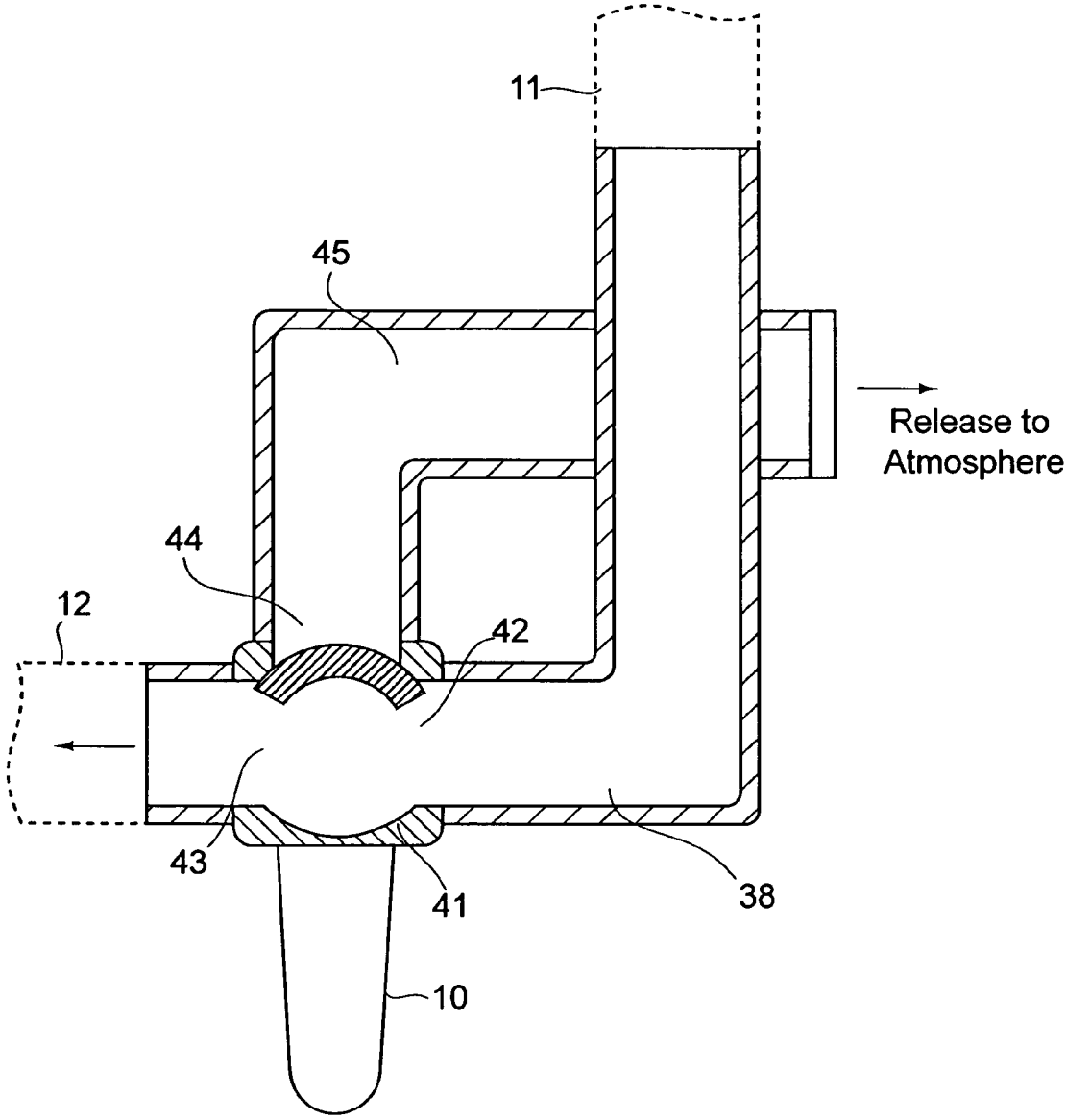
FIG. 8 is a cross-sectional view of the emergency shutdown portion of a first mode (under normal operation).
Figure 9:
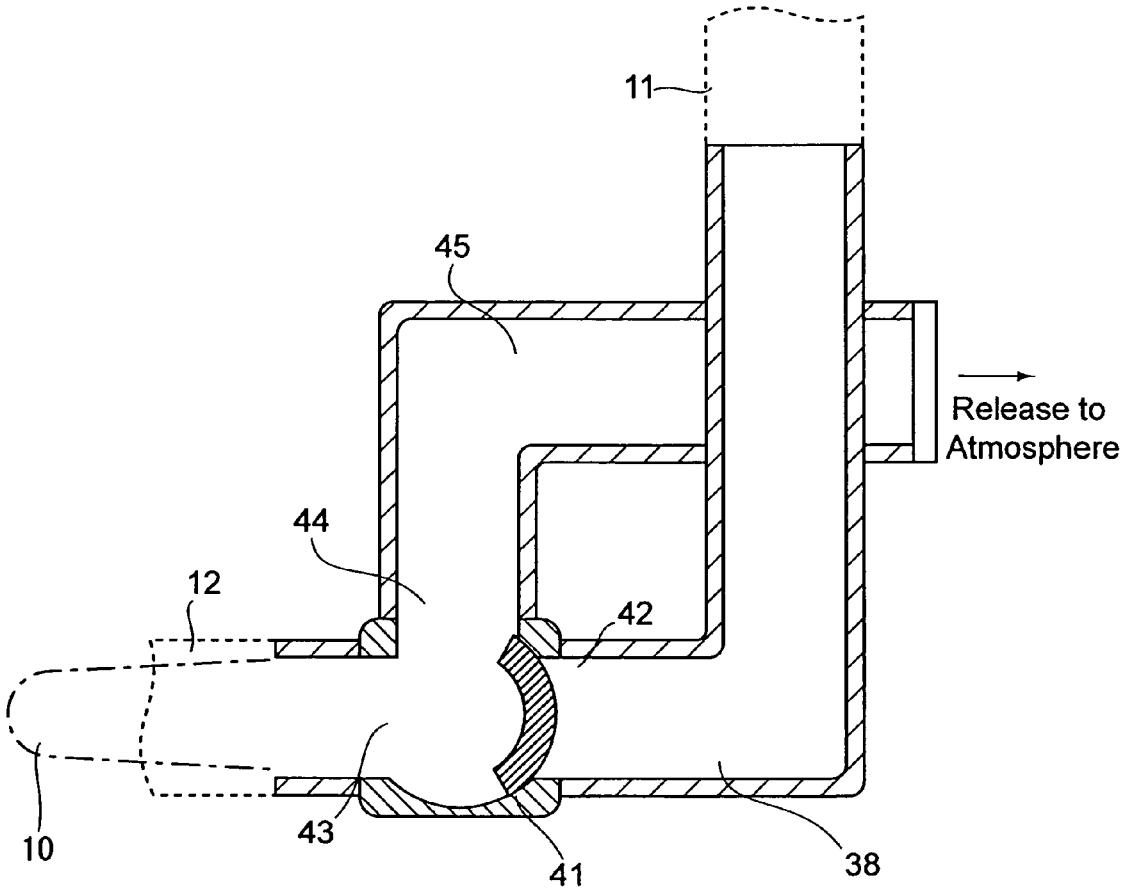
FIG. 9 is a cross-sectional view of the emergency shutdown portion of a second mode (under emergency shutdown).

FIG. 7 is an enlarged diagram of an emergency shutdown portion 9, FIG. 8 is a state of normal operation (not at an emergency shutdown state), and FIG. 9 is a sectional view of the emergency shutdown portion 9.

As shown in FIG. 7 the emergency shutdown portion 9 is comprised of a pipe 38 that stretches from an upper portion to downward (the first portion 36) and bends to the driving seat side at a lower portion (the second portion 37). The upper end portion 39 of the pipe 38 is connected to the pipe 11 and the other end 40 is connected to the air tube 12.

A three-way valve 41, one embodiment of a switching valve, is inserted into the second portion 37 of the pipe 38. A first valve opening 42 of the three-way valve 41 is connected to the pipe 11, a second valve opening 43 is connected to the air tube 12 and a third valve opening 44 is open to atmosphere. The three-way valve 41 can be switched between the first mode and the second mode by manually rotating the lever 10. The first mode enables the flow of the gas between the first valve opening 42 and the second valve opening 43 and the second mode enables the flow of the gas between the second valve opening 43 and a third valve opening 44.

In the present invention, for example, in a case where application of pressure is to be stopped because the receiving side of the molten metal is about to overflow, the three-way valve as a switching valve is manually switched from the first mode to the second mode. With this operation the application of pressure into the container 100 is stopped and, in the same time, the inside of the container 100 is released to atmosphere. Therefore the application of pressure to the container 100 can be stopped certainly in an emergency, and with a very simple operation. In other words, according to the present invention, the first mode and the second mode can be switched from one mode to the other exclusively with one same operation, which is very effective at the time of emergency shutdown.

In addition, since the switching valve of the present invention, can be structured, for example, with a three-way valve, the number of parts can be reduced.

A pipe 45 with its end being open to atmosphere is connected the third valve opening 44. The lower part of the pipe 45 is connected to the third valve opening 44, stretching from the lower portion to the upper portion, and at the upper portion, stretching horizontally to an opposite side of the driving seat. The pipe 38 crosses the first portion 36 and the pipe 38.

At the end of the pipe 45, a joint portion 46 detachably connected to the joint portion 14 of the air tube 12 is provided. When the air tube 12 is not connected to the container 100, the joint portion 14 at the end of the air tube 12 is connected to the joint portion 46 of the pipe 45 so that the air tube 12 can be placed in order. In addition, the air tube can be prevented from flapping when the compressed gas is being supplied.

As shown in FIG. 8, the three-way valve of the emergency shutdown portion 9 is designed to be at the first mode under a normal operation. This configuration allows gas to flow between the first valve opening 42 and the second valve opening 44, therefore, supplying gas for applying pressure to the inside of the container and reducing the pressure in the container 100 using the vacuum pump 7 through the air tube 12 become possible.

Then, for example, when emergency shutdown operation becomes necessary while the gas used for applying pressure to the inside of the container 100 is being supplied from the receiver tank 5, the lever 10 is turned and the three-way valve 41 is switched to the second mode. With this configuration, a flow passage to the first valve opening 42 from the three-way valve 41 is blocked so that the supply of the gas used for applying pressure to the inside of the container 100 from the receiver tank 5 is stopped. In the same time, the flow of the gas becomes possible between the second valve opening 43 and the third valve opening 44 that is release to the atmosphere. With this configuration, the inside of the container 100 is released to the atmosphere. In other words, in the present invention, at a time of emergency, the supply of gas used for applying pressure to the inside of the container 100 can be stopped and, in the same time, inside of the container is released to the atmosphere with one same operation, namely, manually turning the lever 10 provided close to the driving seat, which leads to a high level of safety. Similarly, when the pressure in the container 100 is being reduced using the vacuum pump 7, decreasing the pressure in the container 100 is stopped and, in the same time, inside of the container is released to the atmosphere with a single action, namely, manually turning above-mentioned lever 10.

Next, an example of the container used in another embodiment will be described.

Figure 10:
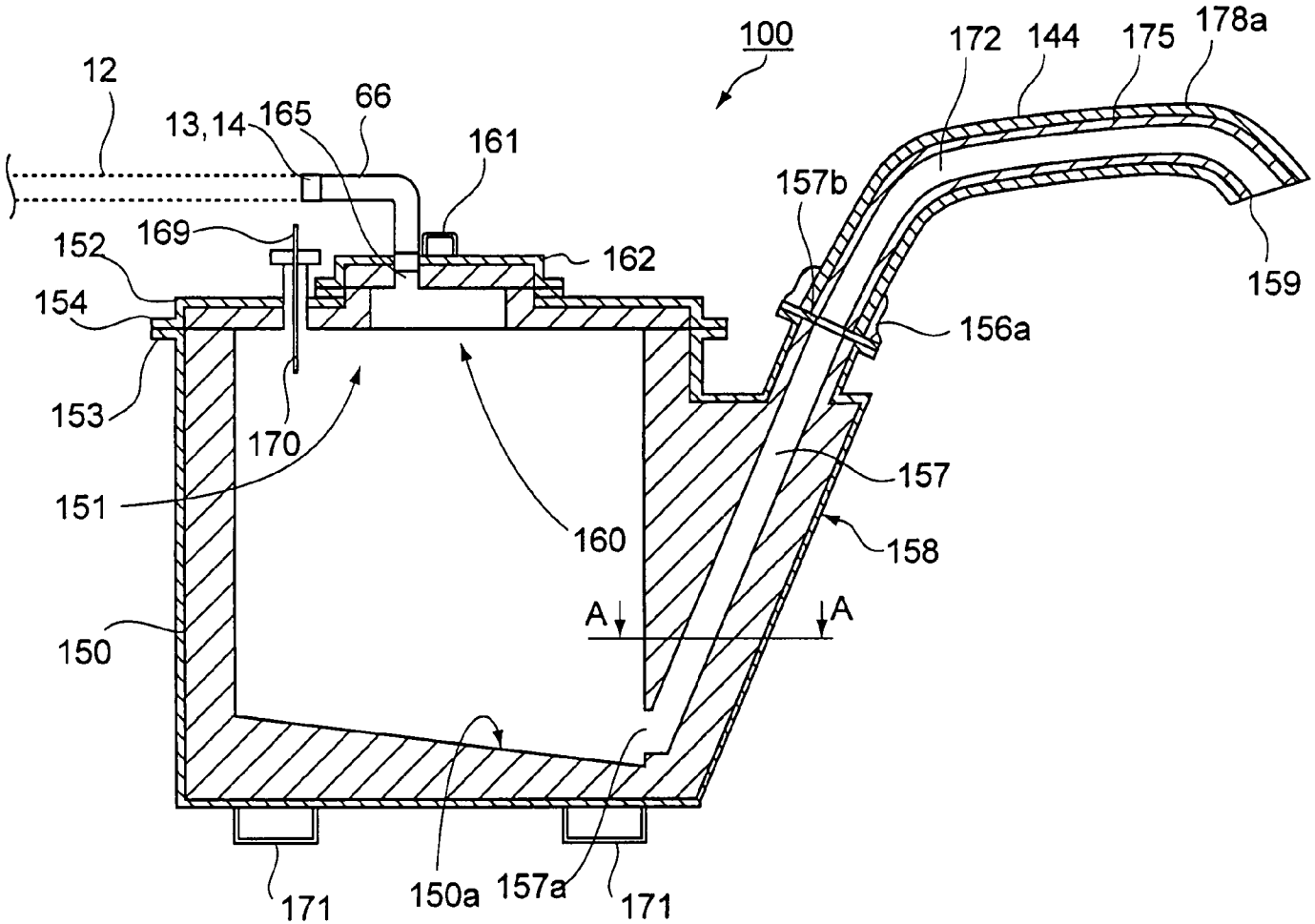
FIG. 10 is a cross-sectional view of the container according to an embodiment of the present invention.
Figure 11:
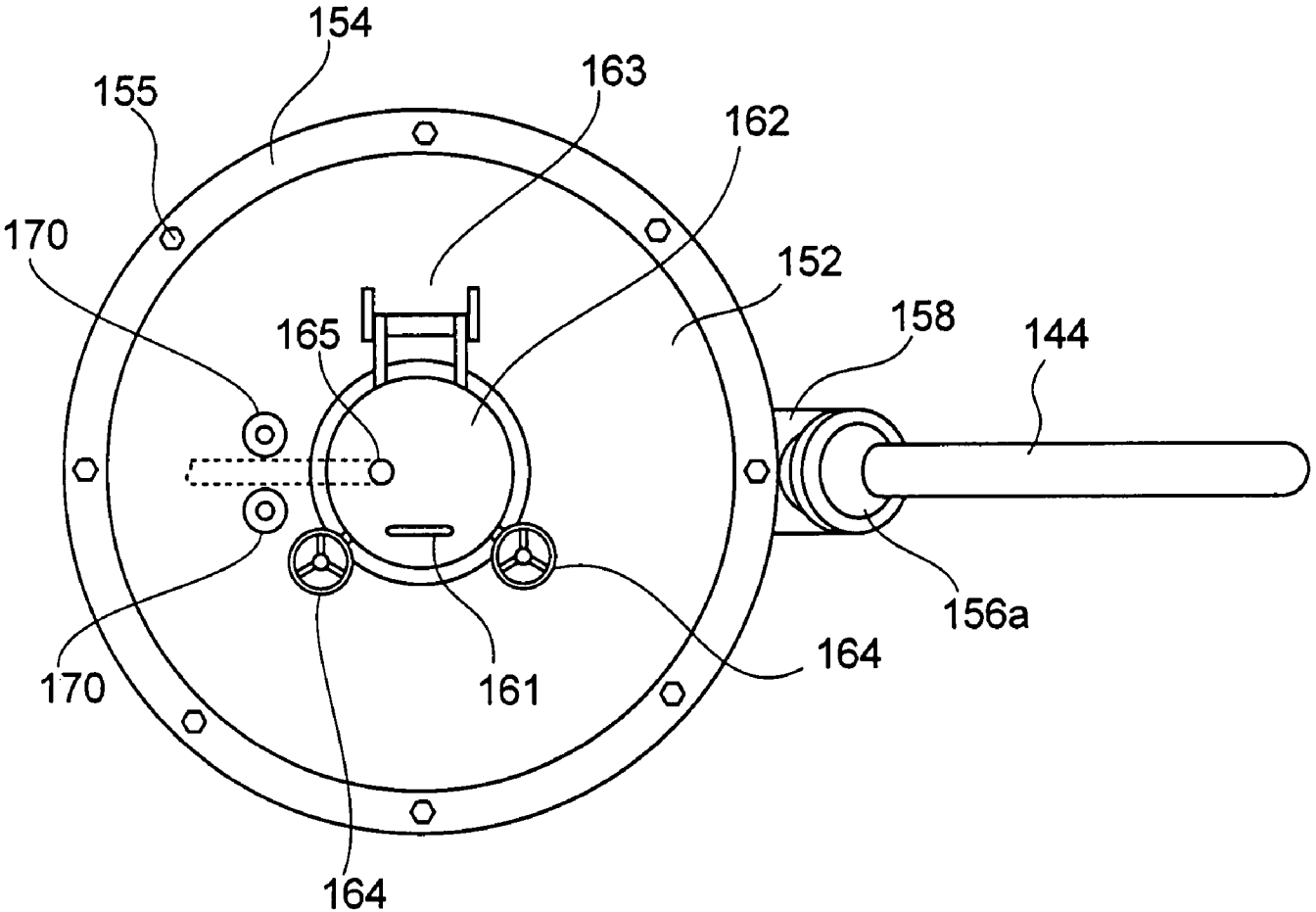
FIG. 11 is a plane view of the container shown in FIG. 10.

FIG. 10 is a cross-sectional view of the container, and FIG. 11 is a plane view thereof. The container 100 is configured such that a large lid 152 is provided at an upper opening 151 of a bottomed cylindrical body 150. Flanges 153 and 154 are provided at outer peripheries of the body 150 and the large lid 151 respectively, so that the flanges are fastened together with bolts 155 to fix the large lid 151 to the body 150. It should be noted that the outside of the body 150 and the large lid 151 is made of, for example, metal and the inside thereof is made of refractories, with a heat insulator being inserted between the metal frame and the refractory material.

At one point on the outer periphery of the body 150, a pipe attachment portion 158 is provided which is provided with a flow path 157 starting from the inside of the body 150 and communicating with the pipe 144.

Figure 12:
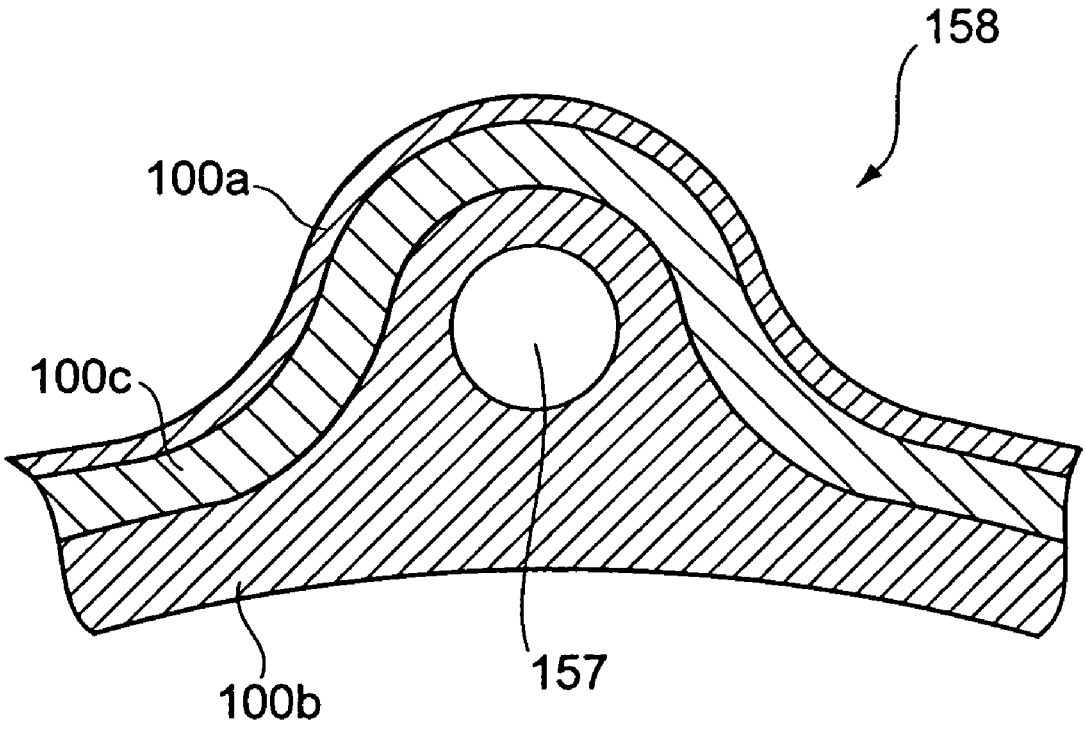
FIG. 12 is a cross sectional view of FIG. 10 cut at A-A line.

Here, FIG. 12 is a cross-sectional view taken along a line A-A across the pipe attachment portion 158 shown in FIG. 10.

As shown in FIG. 12, the outside of the container 100 is constituted of a metal frame 100*a*, and the inside thereof is constituted of a refractory member (the first lining) 100*b*, with a heat insulating member which has a smaller heat conductivity (the second lining) 100*c* being inserted between the frame 100*a* and the refractory member 100*b*. Besides, the flow path 157 is formed to be sheathed in the refractory member 100*b*, which is provided on the of the container 100. In other words, the flow path 157 is provided in the refractory member 100*bs* from a position close to the bottom and inside of the container 100, to an exposed portion of an upper surface of the refractory member 100*b*. With this configuration, the flow path 157 is separated from "inside" of the container by a refractory member with large heat conductivity. The adoption of such configuration enables the released heat to be transmitted to the flow passage. A heat insulating member is disposed on the outside of the refractory member, outside of the flow path (opposite to the container side). The refractory member with higher density and better heat conductivity than heat insulator is used. As a refractory member a fire resistant type ceramic material can be named as an example. As a heat insulator a heat insulating type ceramic material such as heat insulating caster and a board material can be named.

The flow path 157 in the pipe attachment portion 158 extends toward an upper portion 157*b* on the outer periphery of the body 150, through an opening 157*a* provided at a position on the inner periphery of the body 150 close to a bottom portion 150*a* of the container body. The pipe 144 is fixed to communicate with the flow path 157 in the pipe attachment portion 158. One end portion 159 of the pipe 144 faces downward.

In addition, around the pipe 144 close to the pipe attachment portion 158, a heat insulator 44*a* is disposed to surround the pipe 144. With this configuration, the pipe 144 side absorbs heat in the flow path 157 side and the decrease in temperature on the flow path 157 side can be prevented as much as possible. Especially, the molten metal is likely to be cooled off around the pipe 144 close to the pipe attachment portion 158 and also, being a position where the liquid surface sways at a time of transporting the container, the molten metal often solidifies. The solidification of the molten metal can be prevented at this position by surrounding the pipe 144 with the heat insulator 44*a*.

The flow path 157 and the pipe 144 linking thereto are preferably almost the same in inner diameter, about 65 mm to about 85 mm. Conventionally, this kind of pipe has been about 50 mm in inner diameter. This is because large pressure used to be considered necessary when supplying the molten metal from the pipe by applying pressure to the inside of the container. In contrast, the inventors and the like of the present invention concludes that the inside diameter of the pipe 144 is preferable to be of much larger than 50 mm, namely, 65 mm to 85 mm, more preferable to be 70 mm to 80 mm, and even more preferable to be 70 mm. In other words, two parameters, weight of the molten metal in the pipe itself and viscosity resistance of the inside wall of the pipe and the flow path are considered to have a great effect on the resistance that prevents the molten metal from flowing inside the flow path and the pipe to the upper direction. Here, when inside diameter is smaller than 65 mm, the molten metal flowing in the flow path is affected from both the weight of the molten metal itself and the viscosity resistance of the inside wall, however, when inside diameter is larger than 65 mm the area that is not affected from the viscosity resistance of the inside wall emerges from almost the center of the flow and such area gradually spreads. The effect of this area is so large that the resistance that prevents the flow of the molten metal starts to decrease. Therefore, application of a very small pressure in the container is sufficient to supply the molten metal therefrom. In summary, conventionally the existence of such area has not been considered and only the weight of the molten metal itself is used to be regarded as a variable of the resistance that prevents the flow of the molten metal and the inside diameter is used to be around 50 mm from operability and the maintenance point of view. On the other hand, when inside diameter is over 85 mm, the weight of the molten metal as a resistance preventing the flow becomes prevalent resulting in large resistance against the flow of the molten metal. According to the prototype produced by the inventors of the present invention and the like, when inside diameter being 70 mm to 80 mm, a very small pressure is sufficient to be applied to inside of the container. Especially, inside diameter being 70 mm is most preferable, from a point of view both the standardization and the operability. This is because the diameter of a pipe is standardized by 10 mm, namely, 50 mm, 60 mm, 70 mm etc and smaller the diameter, the easier to handle and the better the operability.

By having the diameter of the pipe to be as described above, the pressure necessary for the supply of the molten metal may be decreased. This indicates that using a container of this kind enables to shorten the time of the molten metal being at stand still without decreasing the amount of supplied molten metal per a unit time. For example, in a case where inside of the container is open to atmosphere through, for example, the leak valve 28 and the emergency shutdown portion 9, the smaller the applied pressure (i.e. the smaller the pressure in the container) the shorter the time consumed to return to the atmospheric pressure. Even when the application of the pressure is stopped, the molten metal continues to be supplied to the outside unless the pressure in the container is released. Using a pipe with above-described diameter enables to improve safety when stopping the supply.

At almost the center of the aforementioned large lid 152, an opening 160 is provided, and a hatch 162 with a handle 161 attached thereto is disposed at the opening 160. The hatch 162 is provided at a position slightly higher than the upper face of the large lid 152. A portion on the outer periphery of the hatch 162 is attached to the large lid 152 through a hinge 163. This allows the hatch 162 to freely open and close the opening 160 in the large lid 152. In addition, bolts with handles 164 for fixing the hatch 162 to the large lid 152 are attached to two points of the outer periphery of the hatch 162 in a manner opposite to the position to which the hinge 163 is attached. By closing the opening 160 in the large lid 152 with the hatch 162 and rotating the bolts with handles 164, the hatch 162 is fixed to the large lid 152. On the other hand, by inversely rotating the bolts with handles 164 to release the fixation, the hatch 162 can be opened from the opening 160 in the large lid 152. Then, with the hatch 162 opened, maintenance of the inside of the container 100 and insertion of a gas burner at the time of preheating can be performed through the opening 160.

Further, a through hole 165 for internal pressure adjustment for reducing and applying the pressure in the container 100 is provided at the center or a position slightly off from the center of the hatch 162. To the through hole 165, a pipe 66 for applying and reducing the pressure is connected. The pipe 66 extends upward from the through hole 165, bends at a predetermined height, and extends in the horizontal direction. The surface of a portion of the pipe 66 inserted into the through hole 165 is threaded, and on the other hand, the through hole 165 is also threaded. This firmly screws the pipe 66 to the through hole 165.

An above-described joint portion 13 is provided at a tip of the pipe 66. Then, it is possible to introduce the molten aluminum into the container 100 through the pipe 144 and the flow path 157 using a pressure difference resulting from reducing the pressure, and it is possible to supply the molten aluminum to the outside of the container 100 through the flow path 157 and the pipe 144 using a pressure difference resulting from applying the pressure. It should be noted that use of an inert gas, for example, nitrogen gas as the compressed gas makes it possible to prevent more effectively oxidation of the molten aluminum during the pressurization.

In this embodiment, while the through hole 165 for applying and reducing the pressure is provided in the hatch 162 which is disposed at almost the center portion of the large lid 152, the aforementioned pipe 66 extends in the horizontal direction, thus making it possible to perform safely and easily the work of connecting the pipe 167 for applying or reducing the pressure to the pipe 66. Furthermore, the pipe 66 extends in the horizontal direction as described above and thus can be rotated with respect to the through hole 165 by a small force, so that the pipe 66 screwed to the through hole 165 can be fixed and removed by a very small force, for example, without using a tool.

Further, valves like relief valve, leak valve and other valves are not attached to the container 100 of the present invention. This is what differs from structure of a conventional container.

In the large lid 152, two through holes 170 for level sensors are disposed with a predetermined distance therebetween into which two electrodes 169 are detachably inserted as the level sensors. The electrodes 169 are inserted into the through holes 170 respectively. The electrodes 169 are disposed opposite to each other in the container 100, and their tips extend, for example, to positions at a level almost the same as that of a maximum liquid surface of the molten metal in the container 100. It is thus possible to detect the maximum level of the molten metal in the container 100 by monitoring the conduction state between the electrodes 169, thereby enabling prevention of excessive supply of the molten metal to the container 100 with more reliability.

On the rear face of the bottom portion of the body 150, two channels 171 having a cross section in a square shape into which, for example, a fork of the fork lift truck (not shown) is inserted and a predetermined length, are disposed, for example, in parallel to each other. Further, the entire bottom portion inside the body 150 is inclined to be low on the flow path 157 side. This reduces so-called remained melt when the molten aluminum is supplied to the outside through the flow path 157 and the pipe 144 by compression. In addition, when the container 100 is tilted, for example, at the time of maintenance to pour the molten aluminum to the outside through the flow path 157 and the pipe 144, the angle of tilting the container 100 can be decreased, providing improved safety and workability.

Therefore, in the container 100 of the present invention, since members such as stalks which is constantly being exposed to the molten metals does not have to be provided, there is no need to replace parts as such. In addition, since there is no member such as a stalk that hinders preheating being disposed in the container 100, the operability for preheating is improved and preheating can be performed effectively. Further, when the molten metal is stored in the container 100, an operation such as scooping oxidized substances and the like on the surface of the molten metal is necessary in many cases. When the stalk is disposed in the container, the operation is not easily performed, however, the container 100 has no structure such as a stalk being inside the container 100, operability can be improved. Moreover, the flow path 157 is structured to be located inside the refractory member 100*b* of high heat conductivity, the heat inside of the container 100 can easily be transmitted to the flow path 157. For this reason, decrease in temperature of the molten metal flowing in the flow path 157 can be prevented as much as possible.

As described above, in the container 100 according to this embodiment, the through hole 165 for internal pressure control is provided in the hatch 162, and the pipe 66 for internal pressure adjustment is connected to the through hole 165, so that attachment of metal to the through hole 165 for internal pressure control can be checked every supply of the molten metal into the container 100. This makes it possible to prevent clogging of the pipe 66 and the through hole 165 used for adjusting the internal pressure.

Further, in the container 100 according to this embodiment, the through hole 165 for internal pressure control is provided in the hatch 162, and additionally the hatch 162 is provided at almost the center of the upper face portion of the container 100 corresponding to a position of the molten aluminum where the level of the melt changes and melt drops splash off at a relatively rare, resulting in less attachment of the molten aluminum to the pipe 66 and the through hole 165 used for adjusting the internal pressure. This makes it possible to prevent clogging of the pipe 66 and the through hole 165 used for adjusting the internal pressure.

Further, in the container 100 according to this embodiment, the hatch 162 is provided in the upper face portion of the large lid 152, so that the distance between the rear face of the hatch 162 and the liquid surface is longer by the thickness of the large lid 152 than the distance between the rear face of the large lid 152 and the liquid surface. This reduces the possibility of aluminum attaching to the inner face of the hatch 162 provided with the through hole 165, making it possible to prevent clogging of the pipe 66 and the through hole 165 used for controlling the internal pressure.

Next, an embodiment of a metal supplying system in which the transporting vehicle of the present invention is used will be described.

Figure 13:
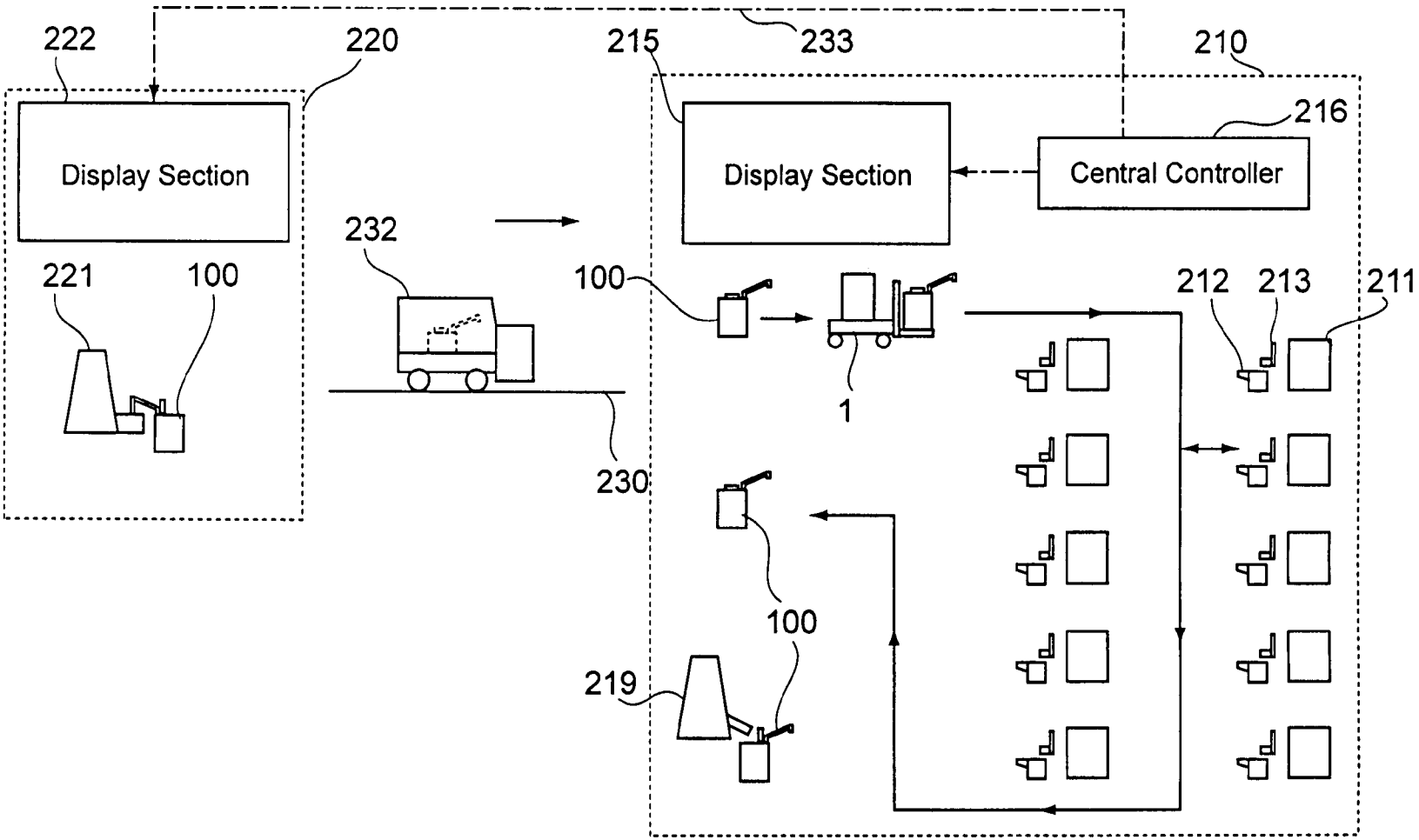
FIG. 13 is a schematic diagram showing the configuration of a metal supply system according to an embodiment of the present invention.

FIG. 13 is a diagram showing the entire configuration of a metal supply system according to an embodiment of the present invention.

As shown in the drawing, a first factory 210 and a second factory 220 are provided at locations apart from each other across, for example, a public road 230.

In the first factory 210, a plurality of die casting machines 211 are arranged as use points. Each of the die casting machines 211 molds products in a desired shape by injection molding using molten aluminum as a raw material. The products can include, for example, parts relating to an engine of an automobile and the like. Besides, the molten metal is not limited only to an aluminum alloy, but alloys containing other metals such as magnesium, titanium, and so on as main constituents are also usable. Near the die casting machines 211, there are storing furnaces (local storing furnaces) 212 that temporarily store molten aluminum before shots. This local storing furnace 212 is designed to store the molten aluminum for a plurality of shots, so that the molten aluminum is injected from the storing furnace 212 into the die casting machine 211 through a ladle 213 or a pipe for every shot. Further, each of the storing furnaces 212 is provided with a level sensor (not shown) that detects the level of the molten aluminum stored in a container 100 and a temperature sensor (not shown) that detects the temperature of the molten aluminum. Detection results by these sensors are passed to a control panel of each of the die casting machines 211 or a central controller 216 in the first factory 210.

The container 100 received to the first factory 210 in the receiving station is carried to a predetermined die casting machine 211 by the transporting vehicle 1, and the molten aluminum is supplied to the storing furnace 212 from the container 100. The container 100 finished with the supply is returned to the receiving portion again mounted on the transporting vehicle 1.

In the first factory 210, a first furnace 219 is provided for melting aluminum and supplying it to the container 100, and the container 100, being supplied with the molten aluminum from the first furnace 219, is also delivered by the transporting vehicle 1 to a predetermined die casting machine 211.

In the first factory 210, a display section 215 is disposed which displays a fact that the die casting machines 211 demand for the additional aluminum melt. More specifically, for example, a unique number is given to every die casting machine 211 and displayed on the display section 215, so that the number on the display section 215 corresponding to the die casting machine 211 which needs addition of the molten aluminum is lighted up. Based on the display on the display section 215, an operator carries the container 100 to the die casting machine 211 corresponding to the number using the transporting vehicle 1 to supply the molten aluminum. The display on the display section 215 is performed by a control of the central controller 216 based on the detection result by the level sensor of the aluminum melt.

In the second factory 220, a second furnace 221 is provided for melting aluminum and supplying it to the container 100. A plurality of types of containers 100 are provided which are different in capacity, pipe length, height, width, and so on. For example, there is a plurality of types of containers 100 different in capacity in accordance with the capacities or the like of the local storing furnaces 212 for the die casting machines 211 in the first factory 210. The containers 100 supplied with the molten aluminum from the second furnace 221 are mounted on a truck 232 for carriage by means of a forklift truck. The truck 232 transports the container 100 via the public road 230 to a receiving portion of the first factory. Besides, vacant containers 100 placed in the receiving station are returned to the second factory 20 by the truck 232.

In the second factory 220, a display section 222 is disposed which states a fact that the die casting machines 211 in the first factory 210 call additional molten aluminum. The display section 222 is almost the same in configuration as the display section 215 in the first factory 210. The display on the display section 222 is performed by a control of the central controller 216 in the first factory 210, for example, via a communication line 233. It should be noted that, out of the die casting machines 211 which need supply of the molten aluminum, the die casting machines 211, which are determined to be supplied with the molten aluminum from the first furnace 219 in the first factory 210, are displayed in distinction from the other die casting machines 211 on the display section 222 in the second factory 220. For example, it is designed to blink the numbers corresponding to the die casting machines 211 determined as above. This can prevent the molten aluminum from being supplied by mistake from the second factory 220 side to the die casting machines 211 which have been determined to be supplied with the molten aluminum from the first furnace 219. Further, on this display section 222, data transmitted from the central controller 216 is also displayed in addition to the above display.

Next, description will be made on the action of the metal supply system configured as described above.

The central controller 216 monitors the amount of the molten aluminum in each of the storing furnaces 212 through the level sensor provided at each of the local storing furnaces 212. When there arises a demand for supplying the molten aluminum to one of the storing furnace 212, the central controller 216 transmits to the second factory 220 side through the communication line 233 the "ID number" of the storing furnace 212, "temperature data" of the storing furnace 212 detected by the temperature sensor provided at the storing furnace 212, "form data" on the form of the storing furnace 212, final "time data" of the storing furnace 212 running out of the molten aluminum, "traffic data" of the public road 230, "amount data" of the molten aluminum required for the storing furnace 212, "temperature data", and soon. In the second factory 220, these data are displayed on the display section 222. Based on these displayed data, the operator determines on his or her experiences the point of time for dispatch of the container 100 from the second factory 220 and the temperature of the molten aluminum at the time of the dispatch so that the container 100 is delivered immediately to the storing furnace 212 before the storing furnace 212 runs out of the molten aluminum and the molten aluminum at that time is at a desired temperature. Alternatively, the data may be downloaded into a computer (not shown) and using the predetermined software, the point of time for dispatch of the container 100 from the second factory 220 and the temperature of the molten aluminum at the time of the dispatch so that the container 100 is delivered immediately to the storing furnace 212 before the storing furnace 212 runs out of the molten aluminum and the molten aluminum at that time is at a desired temperature may be estimated and displayed. Alternatively, it is also adoptable to automatically control the temperature of the second furnace 221 based on the estimated temperature. It is also adoptable to determine the amount of the molten aluminum to be stored in the container 100 based on the aforementioned "amount data."

When the truck 232 with the container 100 mounted thereon departs, passes the public road 230, and arrives at the first factory 210, the container 100 is received from the truck 232 to the receiving station.

Then, the received container 100 is delivered by the transporting vehicle 1 to a predetermined die casting machine 211 so that the molten aluminum is supplied from the container 100 to the storing furnace 212.

The present invention is not limited to each of the embodiment described above, however, can be used in many different format.

INDUSTRIAL AVAILABILITY

As explained above, according to the present invention, application of pressure to the container can be stopped with more reliability, for example, in an emergency, and with a very simple operation. In addition, the time consumed until the stop of the operation can be shortened, leading to improved safety.

In addition, according to the present invention, the pressure in the container can steadily be increased without negatively affecting the operability.

The invention claimed is:

1. A pressure controlling apparatus for controlling a pressure in a container capable of storing a molten metal and supplying the molten metal to an outside using a pressure difference, comprising:

a supplying portion for supplying a compressed gas to be supplied to the container;

a flow passage for supplying the compressed gas from the supplying portion to the container;

a first switching valve, being inserted into the passage, capable of manually switching a first mode that enables the passage of the gas between the supplying portion side and the container side and a second mode that enables the passage of the gas between the container side and the outside;

an exhausting portion for exhausting a gas from the container; and a second switching valve for switching a pressure applying mode for applying a pressure to the container and an exhausting mode for exhausting the gas from the container, wherein the flow passage includes a first path for connecting the supplying portion and the second switching valve, a second path for connecting the exhausting portion and the second switching valve, and a third path for connecting the second switching valve through to the container side, and wherein the first switching valve is inserted into the third path.

2. The pressure controlling apparatus as set forth in claim 1, wherein the switching between the first mode and the second mode is performed exclusively with one same operation.

3. The pressure controlling apparatus as set forth in claim 1, further comprising:

at least one of a leak valve and a relief valve connected to the flow passage.

4. The pressure controlling apparatus as set forth in claim 3, wherein a part of the flow passage is an air tube having a connecting portion connected to the container, and wherein a filter is inserted between the first switching valve and the connecting portion.

5. The pressure controlling apparatus as set forth in claim 1, further comprising:

a compressor, driven by an electricity generated by a generator, the generator being driven by an engine for driving a transporting vehicle for transporting the container with the pressure controlling apparatus being mounted thereon; and a tank for storing the compressed gas compressed by the compressor and supplied from the supplying portion.

6. The pressure controlling apparatus as set forth in claim 1, further comprising:

a compressor driven by an electricity of a battery for supplying electricity to a motor, the motor driving the transporting vehicle for transporting the container with the pressure controlling apparatus being mounted thereon; and a tank for storing the compressed gas being compressed by the compressor and being supplied from the supplying portion.

7. A transporting vehicle for transporting a container capable of storing a molten metal and supplying the molten metal to an outside using a pressure difference, comprising:

an engine for driving the vehicle;

a generator driven by the engine;

a compressor driven by an electricity generated by the generator;

a tank for storing a compressed gas compressed by the compressor; and a pressure controlling portion, having an interface portion detachably disposed against the container, for applying a pressure in the container via the interface portion, the pressure control portion including a flow passage for supplying the compressed gas from the compressor to the container a first switching valve, being inserted into the passage, capable of manually switching a first mode that enables the passage of the gas between the compressor side and the container side and a second mode that enables the passage of the gas between the container side and the outside, an exhausting portion for exhausting a gas from the container, and a second switching valve for switching a pressure applying mode for applying a pressure to the container and an exhausting mode for exhausting the gas from the container, the flow passage including a first path for connecting the compressor and the second switching valve, a second path for connecting the exhausting portion and the second switching valve, and a third path for connecting the second switching valve through to the container side, the first switching valve being inserted into the third path.

8. The transporting vehicle as set forth in claim 7, further comprising: a filter disposed on a line connecting the compressor and the tank.

9. The transporting vehicle as set forth in claim 7, wherein the container has a hatch capable of being opened and closed on a top surface of the container and the interface portion is detachably disposed against a connecting portion on the hatch provided for controlling the pressure in the container.

10. A transporting vehicle for transporting a container capable of storing a molten metal and supplying the molten metal to an outside using a pressure difference, comprising:

a motor for driving the vehicle;

a battery for supplying an electricity to the motor;

a compressor driven by the electricity in the battery;

a tank for storing a compressed gas compressed by the compressor; and a pressure controlling portion, having an interface portion detachably disposed against the container, for applying a pressure in the container via the interface portion, the pressure control portion including a flow passage for supplying the compressed gas from the compressor to the container, a first switching valve, being inserted into the passage, capable of manually switching a first mode that enables the passage of the gas between the compressor side and the container side and a second mode that enables the passage of the gas between the container side and the outside, an exhausting portion for exhausting a gas from the container, and a second switching valve for switching a pressure applying mode for applying a pressure to the container and an exhausting mode for exhausting the gas from the container, the flow passage including a first path for connecting the compressor and the second switching valve, a second path for connecting the exhausting portion and the second switching valve, and a third path for connecting the second switching valve through to the container side, the first switching valve being inserted into the third path.

11. A transporting vehicle for transporting a container capable of storing a molten metal and supplying the molten metal to an outside using a pressure difference, comprising:

a compressor;

a tank for storing a compressed gas compressed by the compressor;

an air tube, having an interface portion detachably disposed against the container on one end, and being connected through to the tank;

a flow passage for supplying the compressed gas from the compressor to the container, the flow passage having a line between the tank and the air tube, in which a gas flows;

a first leak valve connected to the line; and a filter disposed on the line and between the first leak valve and the interface portion;

a first switching valve, being inserted into the passage, capable of manually switching a first mode that enables the passage of the gas between the compressor side and the container side and a second mode that enables the passage of the gas between the container side and the outside;

an exhausting portion for exhausting a gas from the container: and a second switching valve for switching a pressure applying mode for applying a pressure to the container and an exhausting mode for exhausting the gas from the container, the flow passage including a first path for connecting the compressor and the second switching valve, a second path for connecting the exhausting portion and the second switching valve, and a third path for connecting the second switching valve through to the container side, the first switching valve being inserted into the third path.

12. The transporting vehicle as set forth in claim 11, further comprising:

a second leak valve disposed between the first leak valve and the interface portion and connected to the line, wherein the filter is disposed between the second leak valve and the interface portion and on the line.

13. A transporting vehicle for transporting a container capable of storing a molten metal and supplying the molten metal to an outside using a pressure difference, comprising:

a compressor;

a tank for storing a compressed gas compressed by the compressor;

a vacuum pump;

an air tube, having an interface portion detachably disposed against the container on one end;

a first switching portion capable of manually switching a first mode that enables the passage of the gas between the compressor side and the container side and a second mode that enables the passage of the gas between the container side and the outside;

a second switching portion;

a first line becoming a flow passage of a gas flowing between the tank and the second switching portion;

a second line becoming a flow passage of a gas flowing between the vacuum pump and the second switching portion; and a third line becoming a flow passage of a gas flowing between the second switching portion and the air tube, wherein the first switching portion is inserted into the third line being inserted with a switching valve, and wherein the second switching portion switches a connection between the first line and the third line, and the connection between the second line and the third line.

14. The transporting vehicle as set forth in claim 13, further comprising:

a first leak valve disposed between the tank and the interface portion and on one of the first line and the third line; and a filter disposed between the first leak valve and the interface portion and on one of the first line and the third line.

15. The transporting vehicle as set forth in claim 14, further comprising:

a second leak valve disposed between the second switching portion and one end of the air tube and connected to the third line, wherein the filter is disposed between the second leak valve and the air tube on the third line.

16. A pressure difference controlling unit being mounted on a transporting vehicle, holding a container capable of storing a molten metal and supplying the molten metal to an outside using a pressure difference, comprising:

a compressor;

a tank for storing a compressed gas compressed by the compressor; and a pressure controlling portion, having an interface portion detachably disposed against the container, for applying a pressure in the container via the interface portion with the compressed gas, the pressure control portion including a flow passage for supplying the compressed gas from the compressor to the container, a first switching valve, being inserted into the passage, capable of manually switching a first mode that enables the passage of the gas between the compressor side and the container side and a second mode that enables the passage of the gas between the container side and the outside, an exhausting portion for exhausting a gas from the container, and a second switching valve for switching a pressure applying mode for applying a pressure to the container and an exhausting mode for exhausting the gas from the container, the flow passage including a first path for connecting the compressor and the second switching valve, a second path for connecting the exhausting portion and the second switching valve, and a third path for connecting the second switching valve through to the container side, the first switching valve being inserted into the third path.

* * * * *